US005298910A

United States Patent [19]

Takei et al.

[11] Patent Number: 5,298,910

[45] Date of Patent: Mar. 29, 1994

[54] ANTENNA FOR RADIO APPARATUS

[75] Inventors: Ken Takei; Masami Ohnishi, both of Hachioji, Japan

[73] Assignee: Hitachi, Ltd., Tokyo, Japan

[21] Appl. No.: 834,350

[22] Filed: Feb. 12, 1992

[30] Foreign Application Priority Data

Mar. 18, 1991 [JP] Japan ..... 03-052191

[51] Int. Cl.[5] ..... H01Q 1/36; H01Q 11/08

[52] U.S. Cl. ..... 343/895; 343/749

[58] Field of Search ..... 343/895, 745, 749; H01Q 1/36, 11/08, 9/00

[56] References Cited

U.S. PATENT DOCUMENTS 4,148,030 4/1979 Foldes ..... 343/895

FOREIGN PATENT DOCUMENTS 0427654 5/1991 European Pat. Off. ..... 343/895

60-98705 6/1985 Japan ..... 343/895

2077046 12/1981 United Kingdom ..... 343/895

*Primary Examiner*—Donald Hajec

*Assistant Examiner*—Hoanganh Le

*Attorney, Agent, or Firm*—Antonelli, Terry, Stout & Kraus

[57] ABSTRACT

An antenna for radio apparatus comprises a first conductor taking a helical form, a second conductor which extends to and fro in sequence substantially in a direction of the center axis of the helical form of the first conductor to take, as a whole, a meandering form which is spaced apart from the first conductor and surrounds the center axis, and a dielectric member which lies at least between the first and second conductors. A portion of the first conductor is electrically connected to a portion of the second conductor, and either a portion of the first conductor or a portion of the second conductor acts as a feeding point.

38 Claims, 18 Drawing Sheets a-b: BAND REQUIRED BY SYSTEM

ANTENNA FOR RADIO APPARATUS

BACKGROUND OF THE INVENTION

The present invention relates to an antenna for radio apparatus and more particularly to a compact antenna used for a compact portable terminal having a small occupation volume such as a portable mobile terminal.

An inverted F type antenna or a helical antenna has hitherto been employed for the compact portable terminals having a small occupation volume such as portable mobile terminals In either type of antenna, when the antenna volume is decreased as the miniaturization of the terminal advances, a capacitance component larger than a radiation resistance component takes place. In order to cancel this large capacitance component, the conventional antenna needs a matching circuit provided separately from an antenna proper. An example of the conventional antenna is disclosed in, for example, JP-B-2-22563.

In the conventional antenna, characteristics of the antenna having the antenna proper and the matching circuit in combination have to be studied and from a standpoint of occupation volume, the matching circuit forms a factor which limits the miniaturization. Further, the matching circuit is realized with lumped constant elements (inductors and capacitances) or transmission lines and upon incorporation of the antenna into the terminal, these elements must also be incorporated thereinto, thus considerably raising cost.

SUMMARY OF THE INVENTION

An object of the invention is to provide a compact antenna which can obtain a desired matching characteristic without using the separate matching circuit which limits miniaturization of the antenna system as a whole and forms a factor of raising cost when the antenna is incorporated into the terminal.

To accomplish the above object, according to one aspect of the present invention, an antenna comprises a first conductor taking a helical form, a second conductor which extends to and fro in sequence substantially in a direction of the center axis of the helical form of the first conductor to take, as a whole, a meandering form which is spaced apart from the first conductor and surrounds the center axis, and a dielectric member which lies at least between the first and second conductors, a portion of the first conductor being electrically connected to a portion of the second conductor and either a portion of the first conductor or a portion of the second conductor acting as a feeding point.

Firstly, the operation of the invention will be described which proceeds when an intermediate portion (a portion between one end and the other end) of the second conductor is used as a feeding point.

In this case, the second conductor forms, as viewed from the feeding point, two transmission lines in which the radiation resistance results in loss. One of the two transmission lines is a first transmission line formed of a portion (first portion) of the second conductor lying between the feeding point and one end and having an electrical connecting point to the first conductor. The other of the two transmission lines is a second transmission line formed of a portion (second portion) of the second conductor lying between the feeding point and the other end and having no electrical connecting point to the first conductor. If the length of the first portion of the second conductor is set to be sufficiently long for a desired exciting frequency acting on the antenna, then the input impedance of the first transmission line, as viewed from the feeding point, has a positive imarginary conponent of impedance (inductance). Thus, the second transmission line acts as an open stub on the first transmission line, having the function of compensating for the positive imarginary conponent of impedance of the first transmission line to permit matching of the antenna near a center value of the exciting frequency. On the other hand, the first conductor also acts as an open stub on the first transmission line. By selecting a suitable length of the first conductor and a suitable position of the electrical connecting point between the second and first conductors, the impedance of the first conductor can be set to a desired value. Therefore, a double resonance can be obtained near the center value of the exciting frequency to widen the band of impedance matching of the antenna. It will be appreciated that the first conductor takes the helical form and the second conductor takes the meandering form and so main directions of currents caused to flow in these conductors are substantially orthogonal to each other. Consequently, the first and second conductors operate independently from each other, facilitating design of the open stubs.

As described above, the second transmission line and the first conductor act as the open stubs on the first transmission line and so, according to the invention, a compact antenna of wide band can be obtained without using any separate matching circuit.

The operation of the invention has been described by referring to the case where an intermediate portion (a portion between one end and the other end) of the second conductor acts as the feeding point, but in accordance with the invention, an end portion of the second conductor may alternatively be used as the feeding point. In this case, the first open stub lacks but any matching circuit is unneeded as in the precedence.

Also, in the foregoing, the operation of the present invention has been described by referring to the case where a portion of the second conductor is used as the feeding point. However, a portion of the first conductor may act as the feeding point in accordance with the invention and even in such a case, a compact antenna of wide band can be obtained without resort to any separate matching circuit, as in the precedence.

According to another aspect of the invention, an antenna comprises a first conductor taking a helical form, a second conductor which extends to and fro in sequence substantially in a direction of the center axis of the helical form of the first conductor to take, as a whole, a meandering form which is spaced apart from the first conductor and surrounds the center axis, a dielectric member which lies at least between the first and second conductors, and a single or a plurality of fourth conductors spaced apart from the first conductor, a portion of the second conductor acting as a feeding point and a portion of the first conductor being electrically connected to a portion of at least one of the fourth conductors.

In this case, like the foregoing case, any matching circuit is essentially unneeded but since the first conductor is not electrically connected to the second conductor having the feeding point, the first conductor does not act as an open stub. Consequently, in comparison with the foregoing case, the order of the previously-described double resonance is decreased to narrow the frequency band which satisfies the matching condition. However, an unfed section comprised of the first and fourth conductors functions to permit fine adjustment of a center frequency of the matching frequency band, thus facilitating the adjustment of center frequency during fabrication.

DESCRIPTION OF THE PREFERRED EMBODIMENTS

An antenna for radio apparatus of the invention will now be described by way of example with reference to the accompanying drawings.

A first embodiment of the invention will be described by making reference to FIGS. 1A to 1D.

Figure 1A:
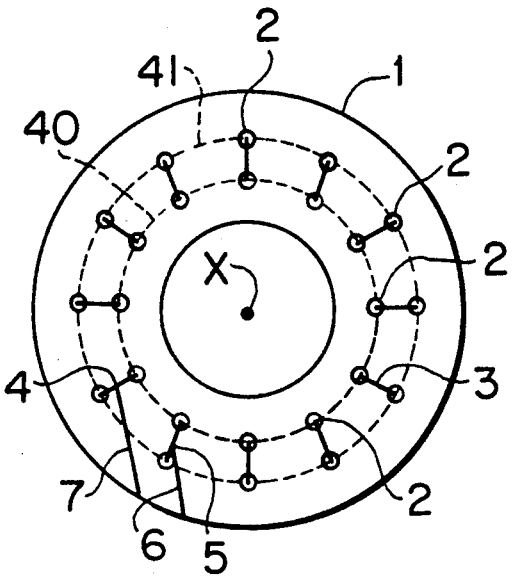
FIG. 1A is a top view of an antenna for radio apparatus according to an embodiment of the invention.
Figure 1B:
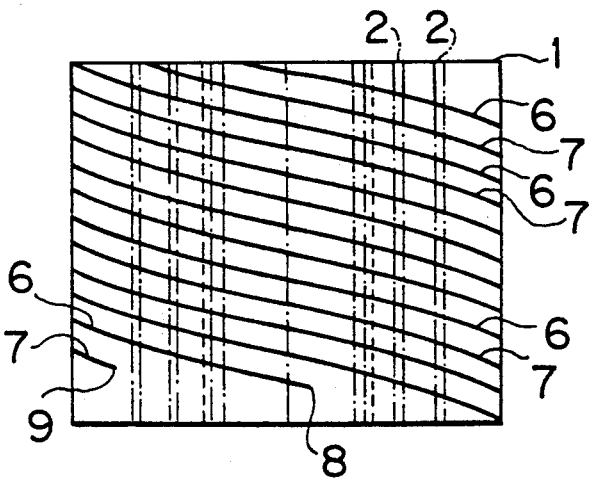
FIG. 1B is a side view of the FIG. 1A radio apparatus antenna.
Figure 1C:
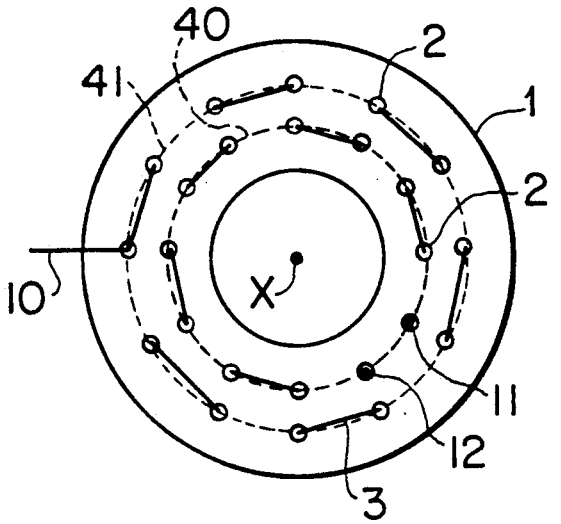
FIG. 1C is a bottom view of the FIG. 1A radio apparatus antenna.
Figure 1D:
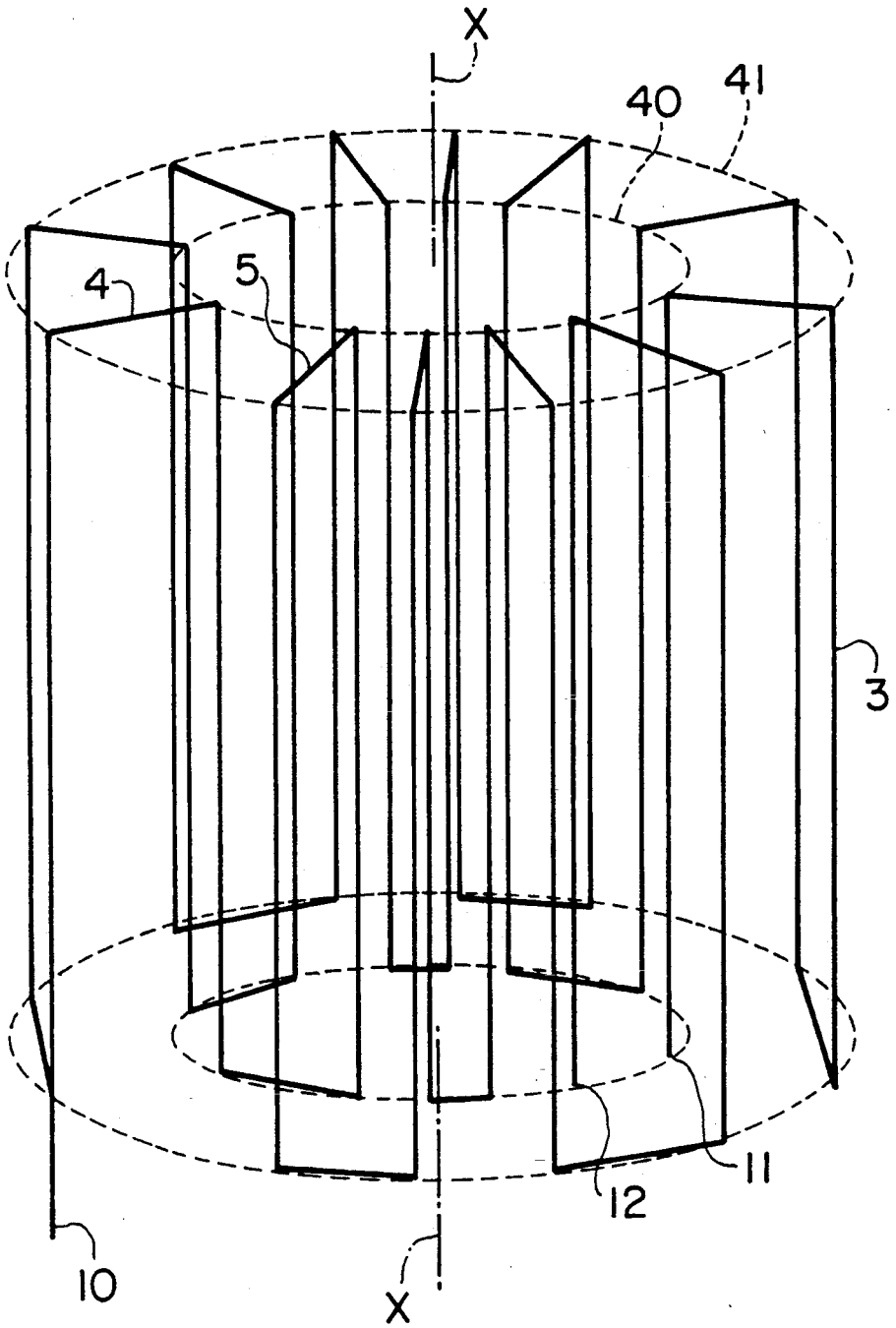
FIG. 1D is a schematic perspective view showing a conductor of the FIG. 1A radio apparatus antenna.

FIGS. 1A to 1C are a top view, a side view and a bottom view of an antenna for radio apparatus according to the first embodiment of the invention, respectively. In these figures, reference numeral 1 designates a dielectric member, 7 a first conductor taking a helical form, 3 a second conductor taking a meandering form and 6 a third conductor taking a helical form. The second conductor 3 is particularly illustrated, in perspective form, in FIG. 1D. In the first embodiment, the dielectric member takes the form of a cylinder. In the dielectric member 1, imaginary, concentric double cylindrical surfaces of inner surface 40 and outer surface 41 are assumed which surround the center axis X, of the cylinder form of dielectric member 1, and guide holes 2 are formed in the inner and outer surfaces in a direction of the center axis X. The second conductor 3 having one end at a start point 11 extends along the guide holes 2 in sequence thereof to take a crank-like meandering form and terminates in the other end at an end point 12. More specifically, as best seen in FIG. 1D, the second conductor 3 extends to and fro in sequence in the direction of the center axis X to take, as a whole, the meandering form which completely surrounds the center axis X. In the first embodiment, parts of the second conductor 3 are exposed to the bottom and top surfaces of the dielectric member 1. The second conductor 3 has an intermediate portion included in the parts exposed to the bottom surface of the dielectric member 1 and this portion is selected as a feeding point 10. The first conductor 7 is wound on the outer surface of the dielectric member 1 by taking the helical form. The center axis of the helical form of the first conductor 7 coincides with the center axis X. Accordingly, the second conductor 3 is spaced apart from the first conductor 7 to leave a plenum which is a part of the dielectric member 1. One end of the first conductor 7 is electrically connected at a connecting point 4 to an intermediate portion of second conductor 3 included in the parts exposed to the top surface of the dielectric member 1. The other end of the first conductor 7 is opened at an ending point 9. In other words, the ending point 9 is not connected electrically to any other parts. The third conductor 6 is also wound on the outer surface of the dielectric member 1 by taking the helical form. The third conductor 6 does not contact the first conductor 7 to form together therewith a multi-helical structure (a double helical structure in this example). One end of the third conductor 6 is electrically connected at a connecting point 5 to an intermediate portion of second conductor 3 included in the parts exposed to the top surface of the dielectric member 1. The other end of the third conductor 6 is opened at an ending point 8. Namely, the ending point 8 is not connected electrically to any other parts.

Figure 2:
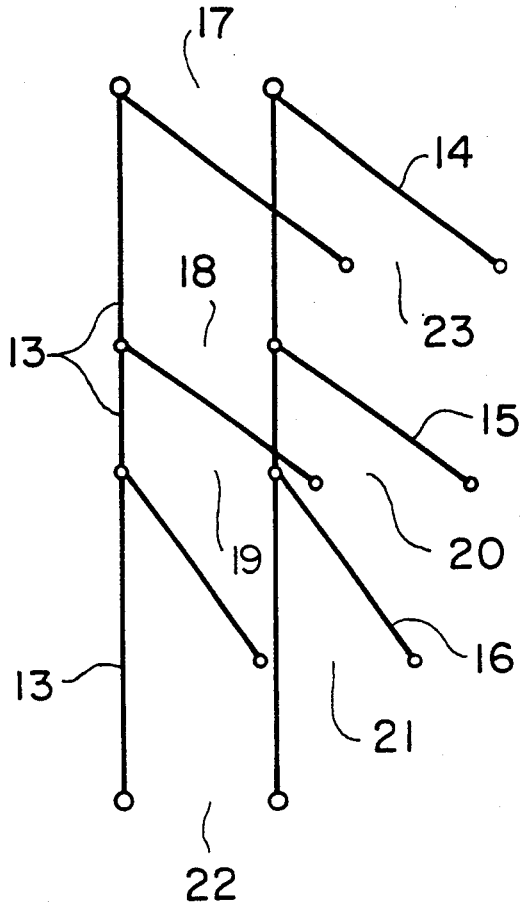
FIG. 2 is a diagram showing a transmission line model of the radio apparatus antenna shown in FIGS. 1A to 1D.

As viewed from the feeding point 10, the antenna for radio apparatus according to the first embodiment shown in FIGS. 1A to 1D can be expressed equivalently by a transmission line model as shown in FIG. 2. A transmission line input terminal 17 corresponds to the feeding point 10. A portion of second conductor 3 lying between the feeding point 10 and the end point 12 corresponds to a transmission line 3, and a portion of second conductor 3 lying between the feeding point 10 and the start point 11 corresponds to a transmission line 14. The connecting points 4 and correspond to other transmission lines 18 and 19, which have different characteristic impedence, respectively. The first conductor 7 corresponds to an open stub 15 and the third conductor 6 corresponds to an open stub 16. The start point 11 of the second conductor 3, the end point 12 of the second conductor 3, the ending point 9 of the first conductor 7 and the ending point 8 of the third conductor 6 correspond to transmission line terminals 23, 22, 20 and 21, respectively. If the length of transmission line 13 is set to be sufficiently large for an exciting frequency of the antenna, then the impedance of transmission line 13 as viewed from the input terminal 17 will be inductive. Since the transmission line 14 is connected in parallel with the transmission line 13, the transmission line 14 acts as an open stub on the transmission line 13 to ensure that the impedance of the antenna can match with the feeding impedance near a center value of the exciting frequency. Further, by selecting suitable lengths of the first and third conductors 7 and 6 as well as suitable positions of the connecting points 4 and 5 in the second conductor 3, the impedances of the open stubs 15 and 16 can be set to desired values. Therefore, with the open stubs 15 and 16, a double resonance can be realized near the center value of the exciting frequency to thereby expand a frequency band which satisfies the matching condition defined by a desired reflection wave characteristic.

Figure 3:
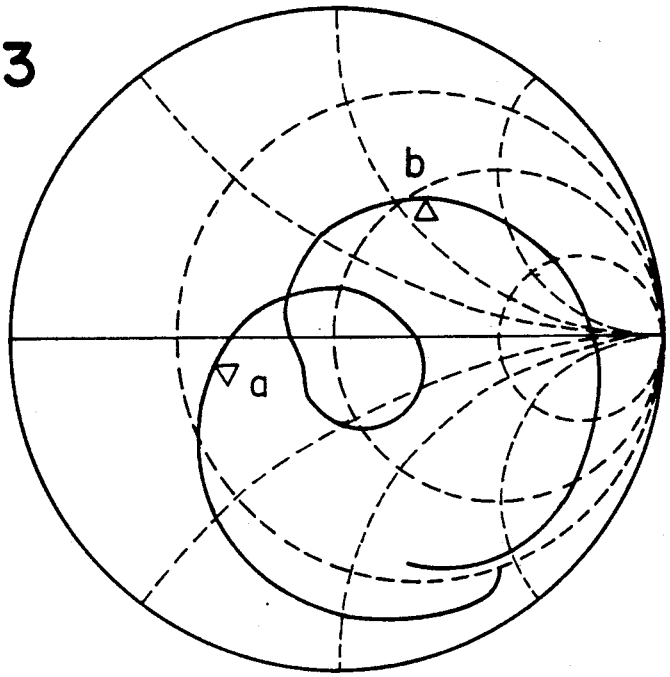
FIG. 3 is a Smith chart showing an example of the matching condition of the radio apparatus antenna shown in FIGS. 1A to 1D.

FIG. 3 depicts an example of a Smith chart showing the condition matched with 50Ω as viewed from the feeding point 10 in the antenna for radio apparatus of the first embodiment. As is clear from this Smith chart normalized by 50Ω, the good matching condition purporting that VSWR<2.5 stands can be realized in a desired frequency band covering a and b.

A second embodiment of the invention will now be described with reference to FIGS. 4A to 4C.

Figure 4A:
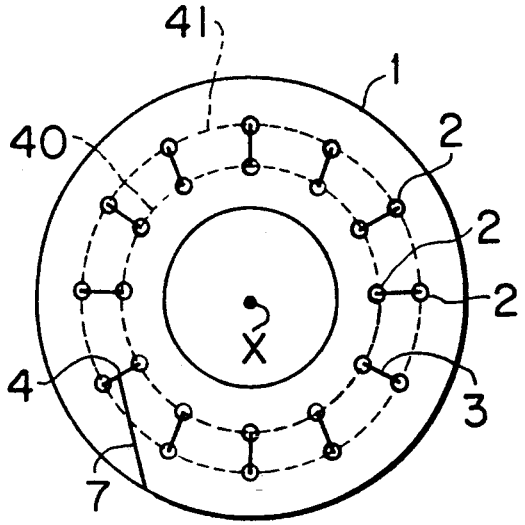
FIG. 4A is a top view of an antenna for radio apparatus according to another embodiment of the invention.
Figure 4B:
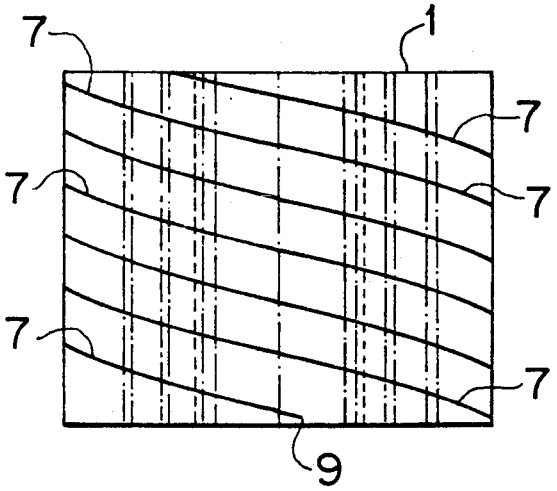
FIG. 4B is a side view of the FIG. 4A radio apparatus antenna.
Figure 4C:
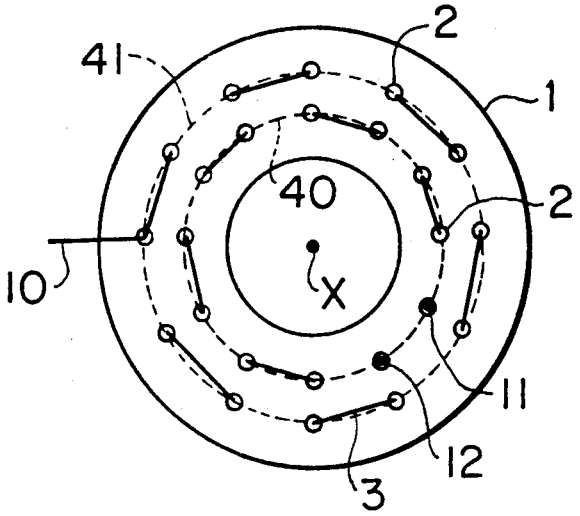
FIG. 4C is a bottom view of the FIG. 4A radio apparatus antenna.

FIGS. 4A to 4C are a top view, a side view and a bottom view of an antenna for radio apparatus according to the second embodiment of the invention, respectively. In these figures, the same components as those of the previously-described first embodiment shown in FIGS. 1A to 1D are designated by the same reference numerals and will not be described herein. The second embodiment differs from the first embodiment only in that the second embodiment lacks the third conductor 6 provided in the first embodiment. Accordingly, in the case of the second embodiment, the order of the double resonance is decreased as compared to the first embodiment to narrow the frequency band which satisfies the matching condition but the production cost can be reduced to advantage. Therefore, the antenna for radio apparatus of the second embodiment can be suitably applicable to the case where the required frequency band is not so wide.

A third embodiment of the invention will now be described with reference to FIGS. 5A to 5D.

Figure 5A:
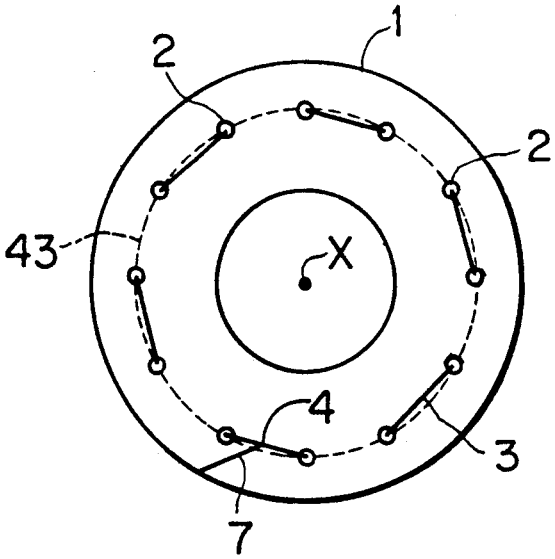
FIG. 5A is a top view of an antenna for radio apparatus according to still another embodiment of the invention.
Figure 5B:
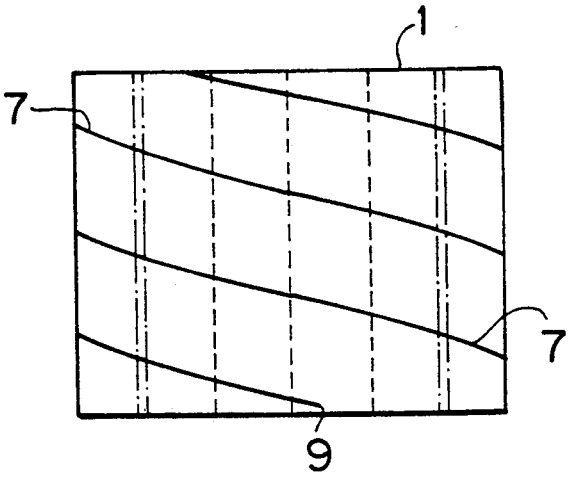
FIG. 5B is a side view of the FIG. 5A radio apparatus antenna.
Figure 5C:
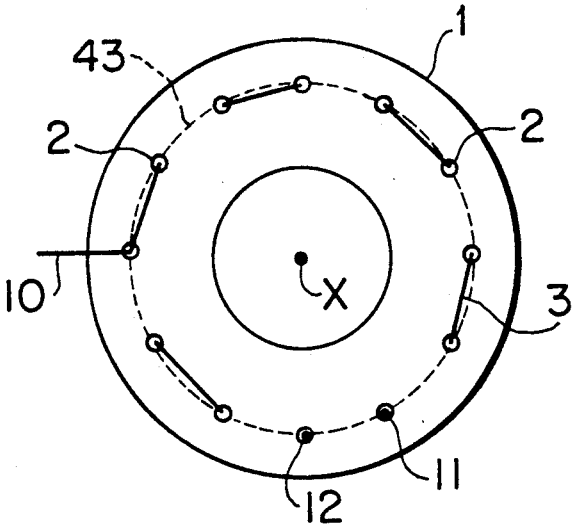
FIG. 5C is a bottom view of the FIG. 5A radio apparatus antenna.
Figure 5D:
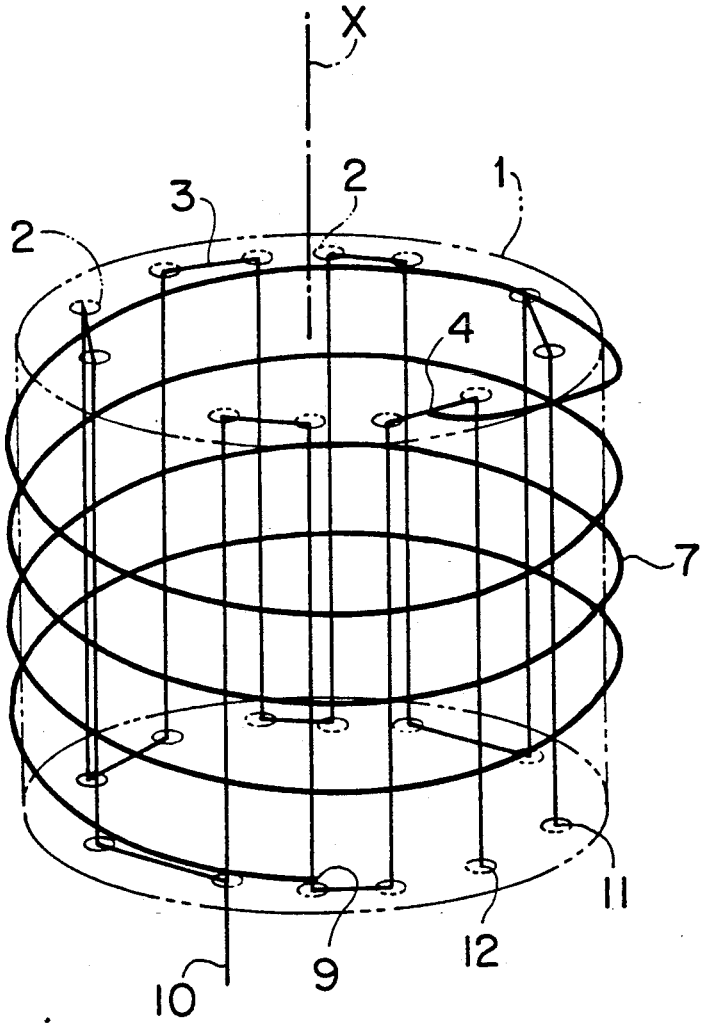
FIG. 5D is a schematic perspective view showing conductors of the FIG. 5A radio apparatus antenna.

FIGS. 5A to 5C are a top view, a side view and a bottom view of an antenna for radio apparatus according to the third embodiment of the invention, respectively. FIG. 5D is a perspective view showing a first conductor 7 and a second conductor 3. In these figures, components like those of the previously-described second embodiment shown in FIGS. 4A to 4C are designated by identical reference numerals and their descriptions will be omitted. The third embodiment is identical with the second embodiment with the only exception of the form of the second conductor 3. More specifically, in the third embodiment, the second conductor 3 takes a meandering form along an imaginary, concentric cylindrical surface 43 which is assumed to be in a dielectric member 1. The third embodiment is disadvantageous to lower frequencies because the overall length of the second conductor 3 can not be longer than that in the second embodiment, but advantageously the construction is simplified to reduce the production cost. Therefore, the antenna for radio apparatus of the third embodiment is suitable for the case where the required frequency band does not extend to so low a frequency.

Now, a fourth embodiment of the invention will be described with reference to FIGS. 6A to 6C.

Figure 6A:
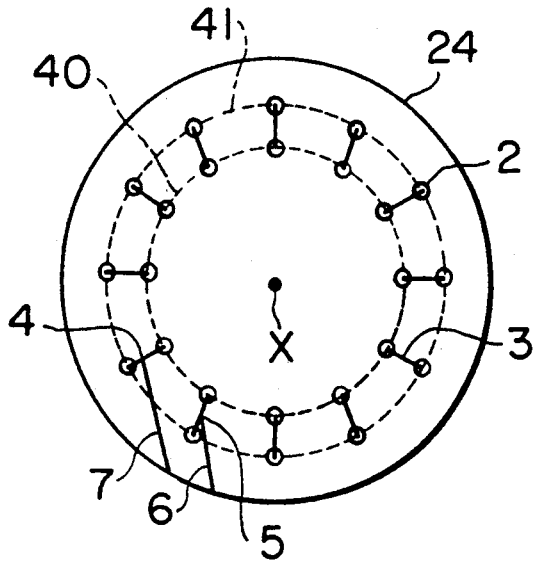
FIG. 6A is a top view of an antenna for radio apparatus according to still another embodiment of the invention.
Figure 6B:
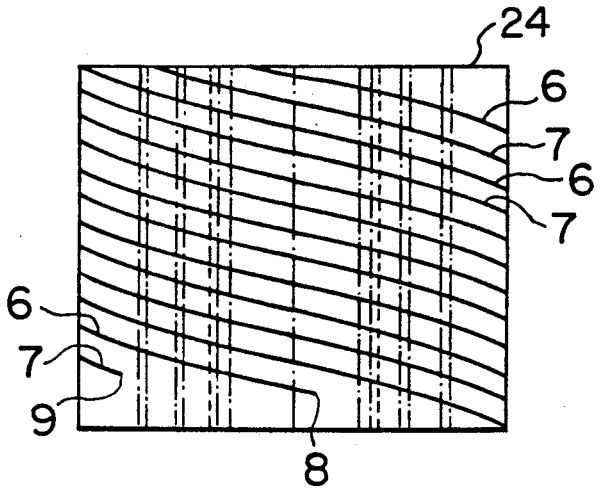
FIG. 6B is a side view of the FIG. 6A radio apparatus antenna.
Figure 6C:
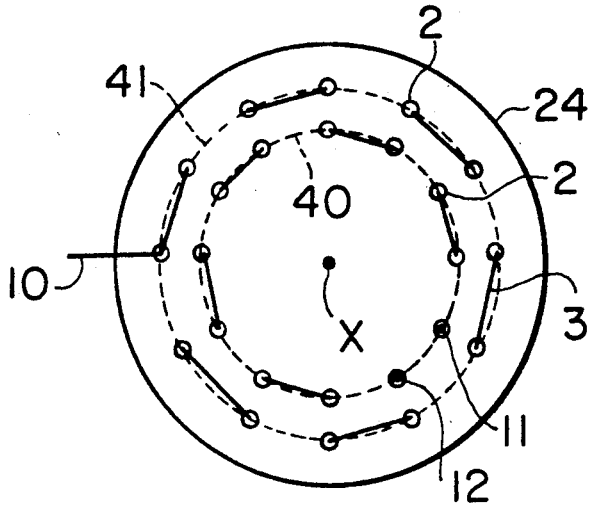
FIG. 6C is a bottom view of the FIG. 6A radio apparatus antenna.

FIGS. 6A to 6C are a top view, a side view and a bottom view of an antenna for radio apparatus according to the fourth embodiment of the invention, respectively. In these figures, components like those of the previously-described first embodiment shown in FIGS. 1A to 1D are designated by identical reference numerals and their descriptions will be omitted. The fourth embodiment differs from the first embodiment only in that while in the first embodiment the cylindrical dielectric member 1 is used, a dielectric member 24 taking a columnar form is used in the fourth embodiment. The antenna for radio apparatus of the fourth embodiment can also provide a characteristic similar to that obtained with the first embodiment and besides, in comparison with the dielectric member 1 of the first embodiment, the dielectric member 24 taking the columnar form attains such advantages that it is easy to manufacture and is increased in mechanical strength to ultimately increase mechanical strength of the whole antenna.

A fifth embodiment of the invention will now be described with reference to FIGS. 7A to 7D.

Figure 7A:
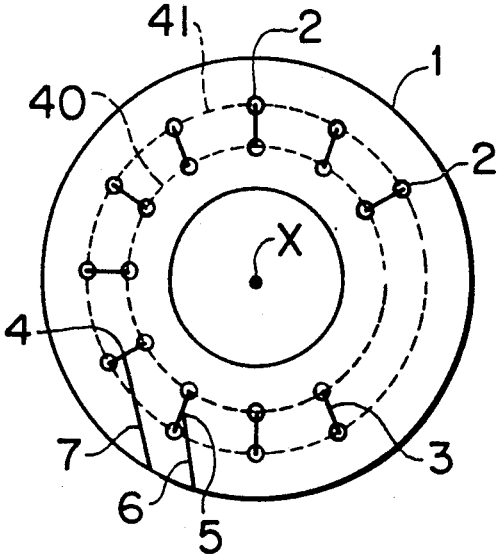
FIG. 7A is a top view of an antenna for radio apparatus according to still another embodiment of the invention.
Figure 7B:
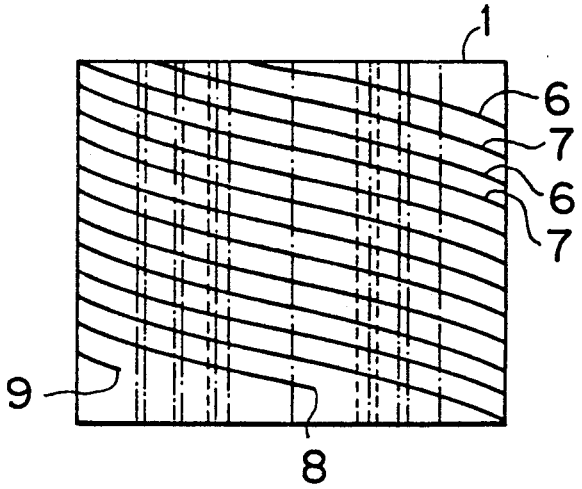
FIG. 7B is a side view of the FIG. 7A radio apparatus antenna.
Figure 7C:
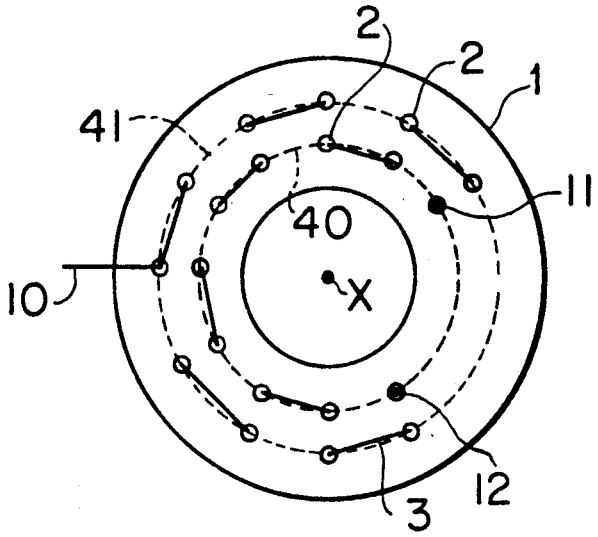
FIG. 7C is a bottom view of the FIG. 7A radio apparatus antenna.
Figure 7D:
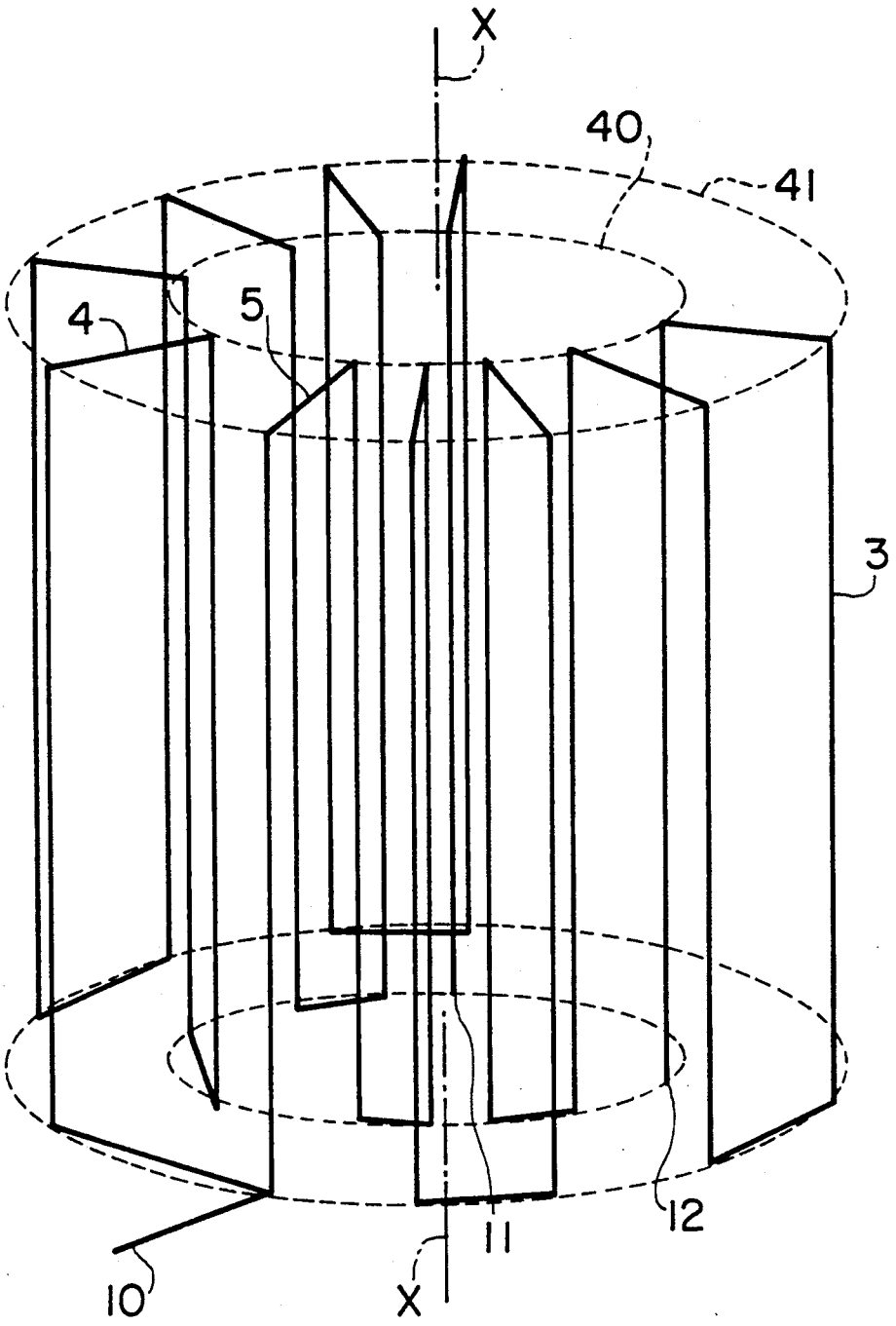
FIG. 7D is a schematic perspective view showing a conductor of the FIG. 7A radio apparatus antenna.

FIGS. 7A to 7C are a top view, a side view and a bottom view of an antenna for radio apparatus according to the fifth embodiment of the invention, respectively. FIG. 7D is a perspective view of a second conductor 3. In these figures, components like those of the previously-described first embodiment are designated by identical reference numerals and their descriptions will be omitted. The fifth embodiment differs from the first embodiment only in that while in the first embodiment the second conductor 3 as a whole takes the meandering form which completely surrounds the center axis X, the second conductor 3 in the fifth embodiment takes as a whole a meandering form which partially surrounds the center axis X. In the fifth embodiment, intensity of radiation of electromagnetic wave is relatively decreased in a direction in which the second conductor 3 is absent as viewed from the center axis X. Accordingly, by packaging the radio apparatus antenna of the fifth embodiment in a terminal in such a manner that the direction of elements apt to be adversely affected by radiation of electric wave (for example, wiring patterns of a microcomputer comprised in the terminal) coincides with the direction of the absence of the second conductor 3, interaction of unwanted high frequency signals with the elements can advantageously be suppressed. The overall length of the second conductor 3 is shorter in the fifth embodiment than in the first embodiment and therefore the fifth embodiment is suitable for the case where the required overall length of the second conductor 3 is not so long.

A sixth embodiment of the invention will now be described with reference to FIGS. 8A to 8C.

Figure 8A:
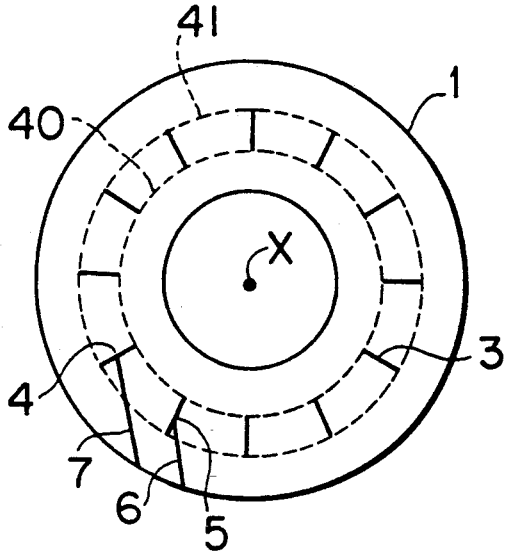
FIG. 8A is a top view of an antenna for radio apparatus according to still another embodiment of the invention.
Figure 8B:
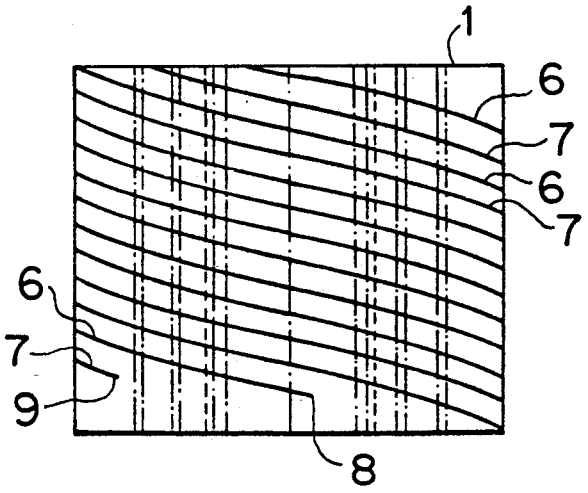
FIG. 8B is a side view of the FIG. 8A radio apparatus antenna.
Figure 8C:
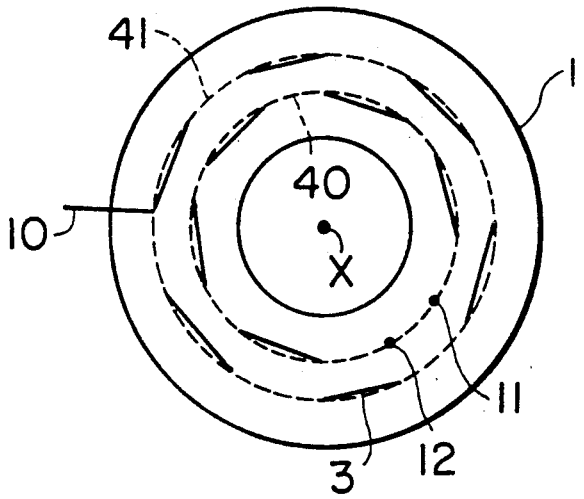
FIG. 8C is a bottom view of the FIG. 8A radio apparatus antenna.

FIGS. 8A to 8C are a top view, a side view and a bottom view of an antenna for radio apparatus according to the sixth embodiment of the invention, respectively. In these figures, components like those of the previously-described first embodiment are designated by identical reference numerals and their descriptions will be omitted. The sixth embodiment differs from the first embodiment only in that while in the first embodiment the second conductor 3 is guided through the guide holes 2 formed in the dielectric member 1, such guide holes are not formed in a dielectric member 1 in accordance with the sixth embodiment and the second conductor 3 is embedded directly in the dielectric member 1. The sixth embodiment requires an integral formation technique for its manufacture but advantageously the relative position of the second conductor 3 in the dielectric member 1 permanently remains unchanged to suppress changes in characteristics with time.

A seventh embodiment of the invention will now be described with reference to FIGS. 9A to 9D.

Figure 9A:
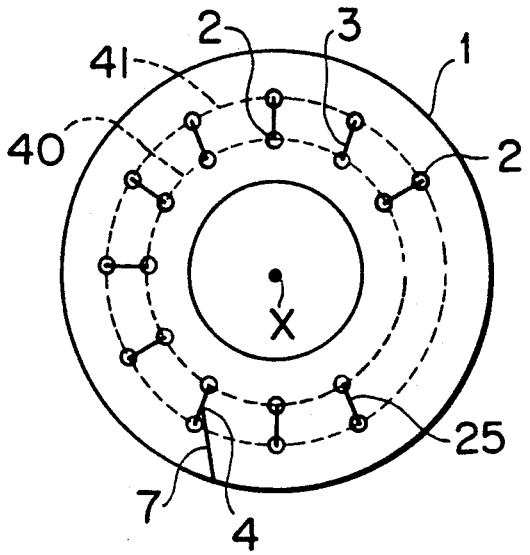
FIG. 9A is a top view of an antenna for radio apparatus according to still another embodiment of the invention.
Figure 9B:
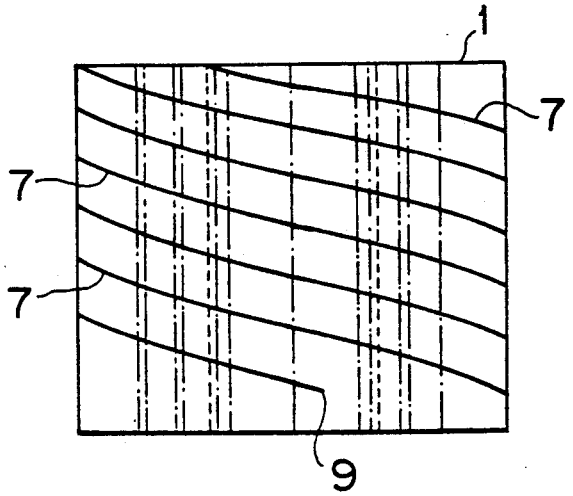
FIG. 9B is a side view of the FIG. 9A radio apparatus antenna.
Figure 9C:
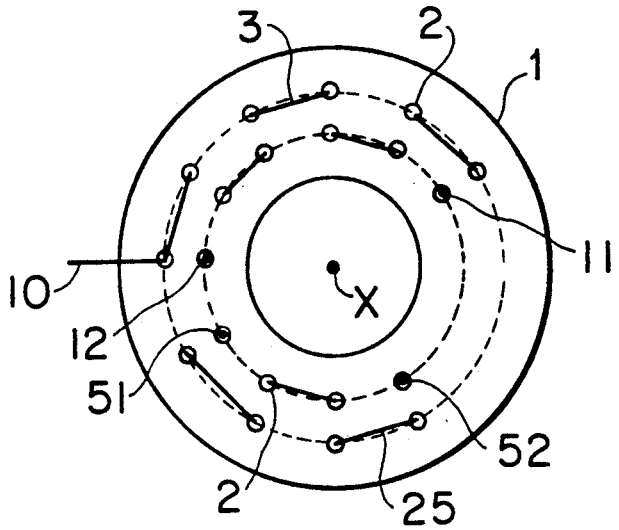
FIG. 9C is a bottom view of the FIG. 9A radio apparatus antenna.
Figure 9D:
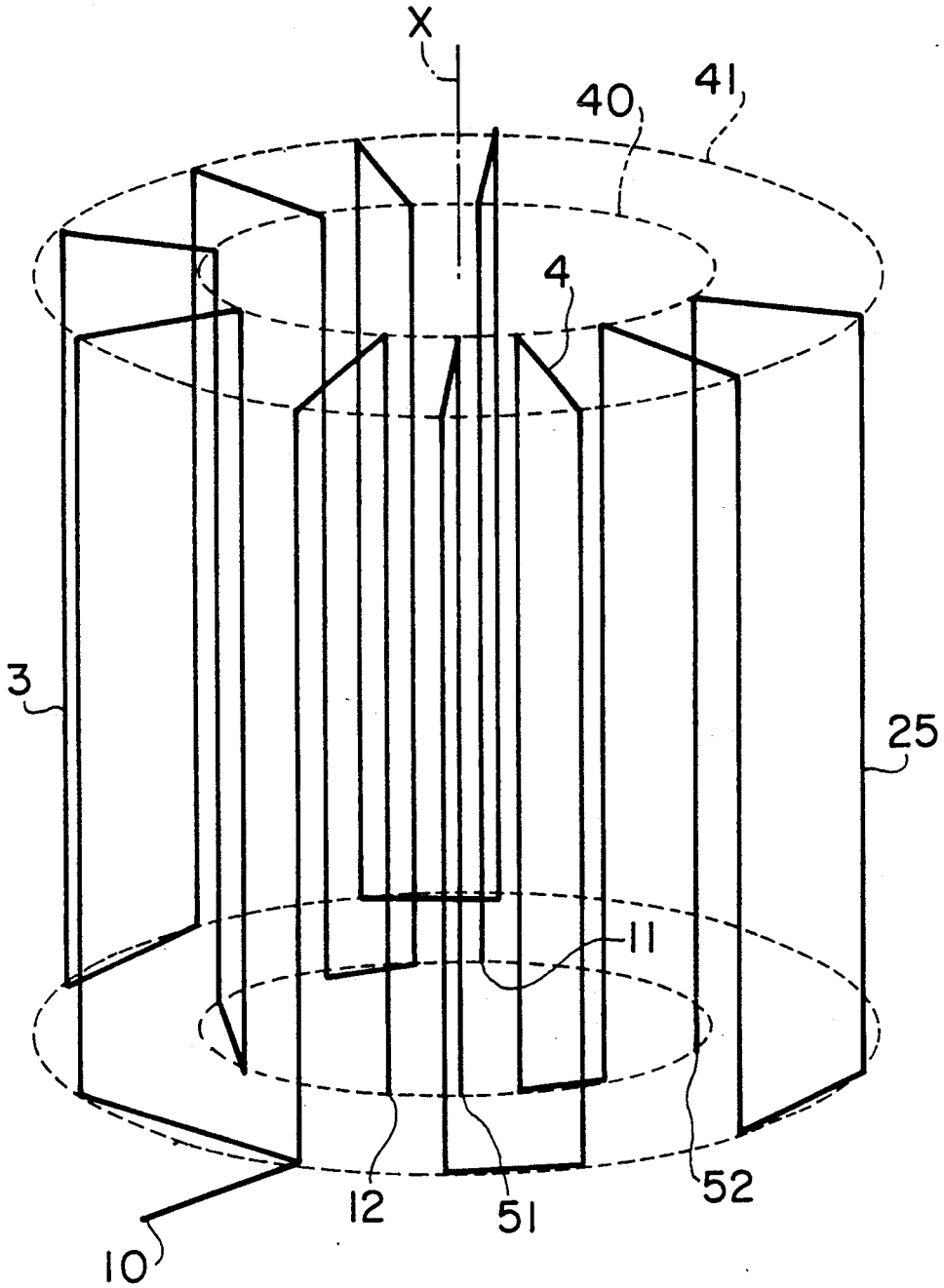
FIG. 9D is a schematic perspective view showing conductors of the FIG. 9A radio apparatus antenna.

FIGS. 9A to 9C are a top view, a side view and a bottom view of an antenna for radio apparatus according to the seventh embodiment of the invention. FIG. 9D is a perspective view showing a second conductor 3 and a fourth conductor 25. In these figures, components like those of the previously-described second embodiment shown in FIGS. 4A to 4C are designated by identical reference numerals and their descriptions will be omitted. The seventh embodiment differs from the second embodiment in that while in the second embodiment the second conductor 3 as a whole takes the meandering form which completely surrounds the center axis X, the second conductor 3 in the seventh embodiment takes as a whole a meandering form which partially surrounds the center axis X, that the seventh embodiment has the fourth conductor 25, and that in the seventh embodiment a first conductor 7 is not electrically connected to the second conductor 3 but is electrically connected at a connecting point 4 to the fourth conductor 25. In the seventh embodiment, the fourth conductor 25 having one end at a start point 51 extends along guide holes 2 in sequence thereof to take a meandering form and terminates in the other end at an end point 52. Accordingly, the fourth conductor 25 is spaced apart from the first conductor 7. Since in the seventh embodiment the first conductor 7 is not electrically connected to the second conductor 3 having a feeding point 10, the first conductor 7 does not act as an open stub on a portion of second conductor 3 lying between start point 11 and feeding point 10. Accordingly, in comparison with the second embodiment, the order of the previously-described double resonance is decreased to narrow the frequency band which satisfies the matching condition. The seventh embodiment, however, has an unfed section (a set of first and fourth conductors 7 and 25) and the function of this unfed section can advantageously be utilized to carry out fine adjustment of the center frequnecy of the matching frequency band to thereby facilitate the adjustment of center frequency during fabrication.

Referring now to FIGS. 10A to 10D, an eighth embodiment of the invention will be described.

Figure 10A:
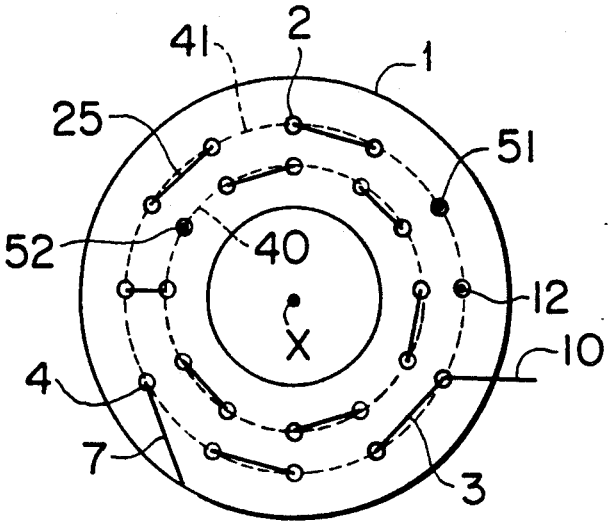
FIG. 10A is a top view of an antenna for radio apparatus according to yet still another embodiment of the invention.
Figure 10B:
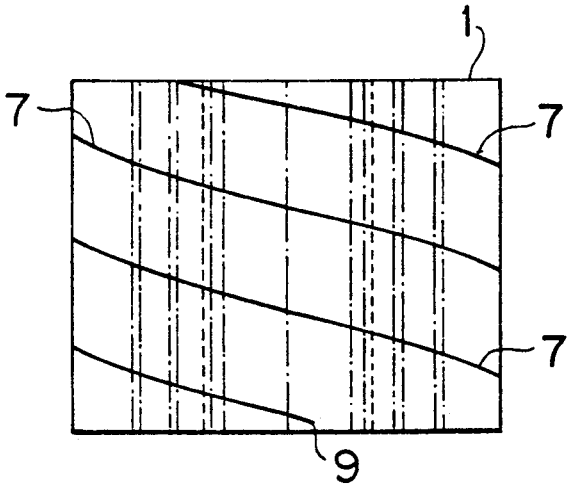
FIG. 10B is a side view of the FIG. 10A radio apparatus antenna.
Figure 10C:
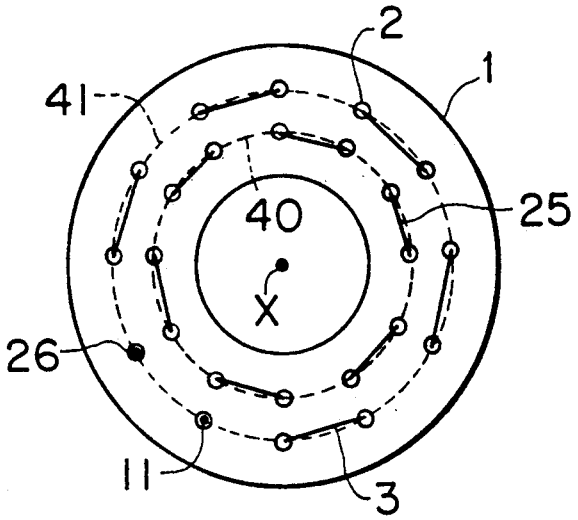
FIG. 10C is a bottom view of the FIG. 10A radio apparatus antenna.
Figure 10D:
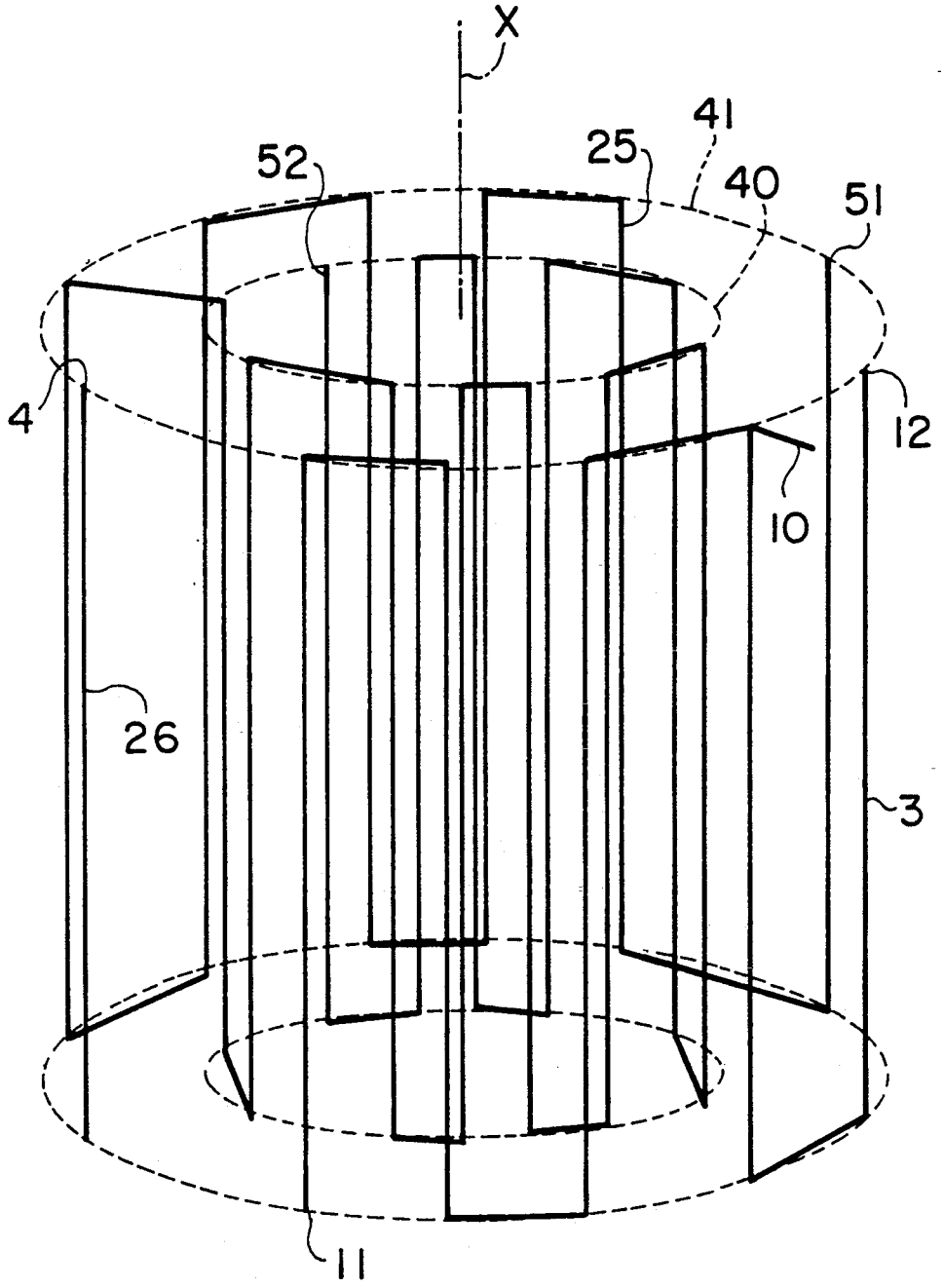
FIG. 10D is a schematic perspective view showing conductors of the FIG. 10A radio apparatus antenna.

FIGS. 10A to 10C are a top view, a side view and a bottom view of an antenna for radio apparatus according to the eighth embodiment of the invention. FIG. 10D is a perspective view showing a second conductor 3 and two fourth conductors 25 and 26. In these figures, components like those of the previously-described second embodiment shown in FIGS. 4A to 4C are designated by identical reference numerals and their descriptions will be omitted. The eighth embodiment differs from the second embodiment in that while in the second embodiment the second conductor 3 as a whole takes the meandering form which completely surrounds the center axis X, the second conductor 3 in the eighth embodiment takes as a whole a meandering form which partially surrounds the center axis X, that the eighth embodiment has the two fourth conductors 25 and 26, and that in the eighth embodiment a first conductor 7 is not electrically connected to the second conductor 3 but is electrically connected at a connecting point 4 to the fourth conductor 26. In the eighth embodiment, the fourth conductor 26 is rectilinear The fourth conductor 25 having one end at a start point 51 extends along guide holes 2 in sequence thereof to take a meandering form and terminates in the other end at an end point 52. Thus, the fourth conductors 25 and 26 are spaced apart from the first conductor 3. The fourth conductor 25 is not electrically connected to any other conductors. Since in the eighth embodiment the first conductor 7 is not electrically connected to the second conductor 3 having a feeding point 10, the first conductor 7 does not act as an open stub on a portion of second conductor 3 lying between start point 11 and feeding point 10. Accordingly, in comparison with the second embodiment, the order of the previously-described double resonance is decreased to narrow the frequency band which satisfies the matching condition. The eighth embodiment, however, has an unfed section (a set of first and fourth conductors 7 and 26 as well as the fourth conductor 25) and the function of this unfed section can advantageously be utilized for fine adjustment of the center frequency of the matching frequency band, thereby facilitating the adjustment of center frequency during fabrication.

Referring now to FIGS. 11A to 11D, a ninth embodiment of the invention will be described.

Figure 11A:
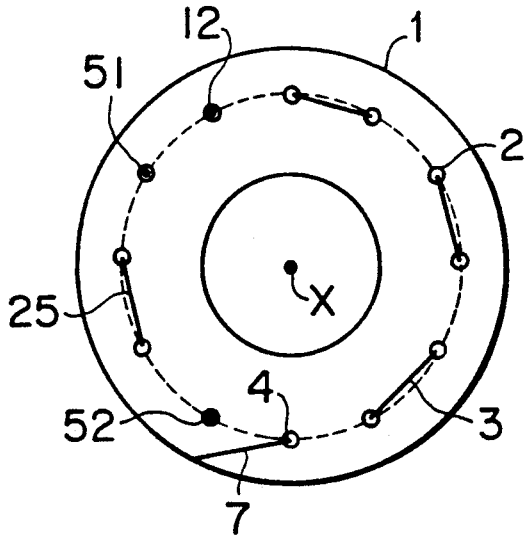
FIG. 11A is a top view of an antenna for radio apparatus according to yet still another embodiment of the invention.
Figure 11B:
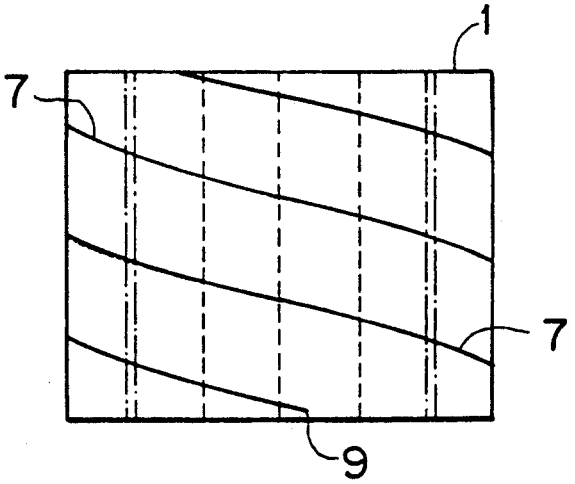
FIG. 11B is a side view of the FIG. 11A radio apparatus antenna.
Figure 11C:
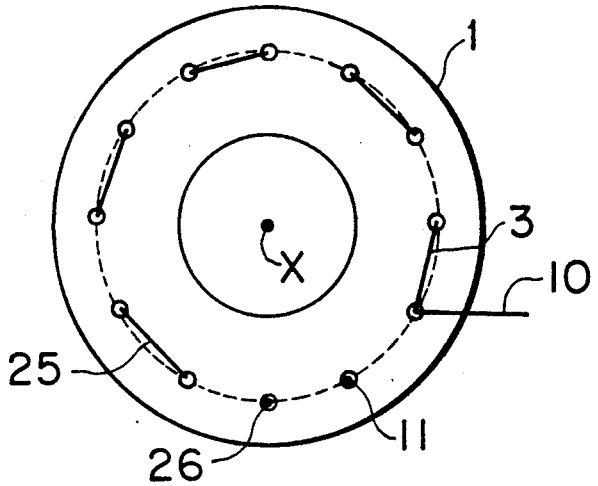
FIG. 11C is a bottom view of the FIG. 11A radio apparatus antenna.
Figure 11D:
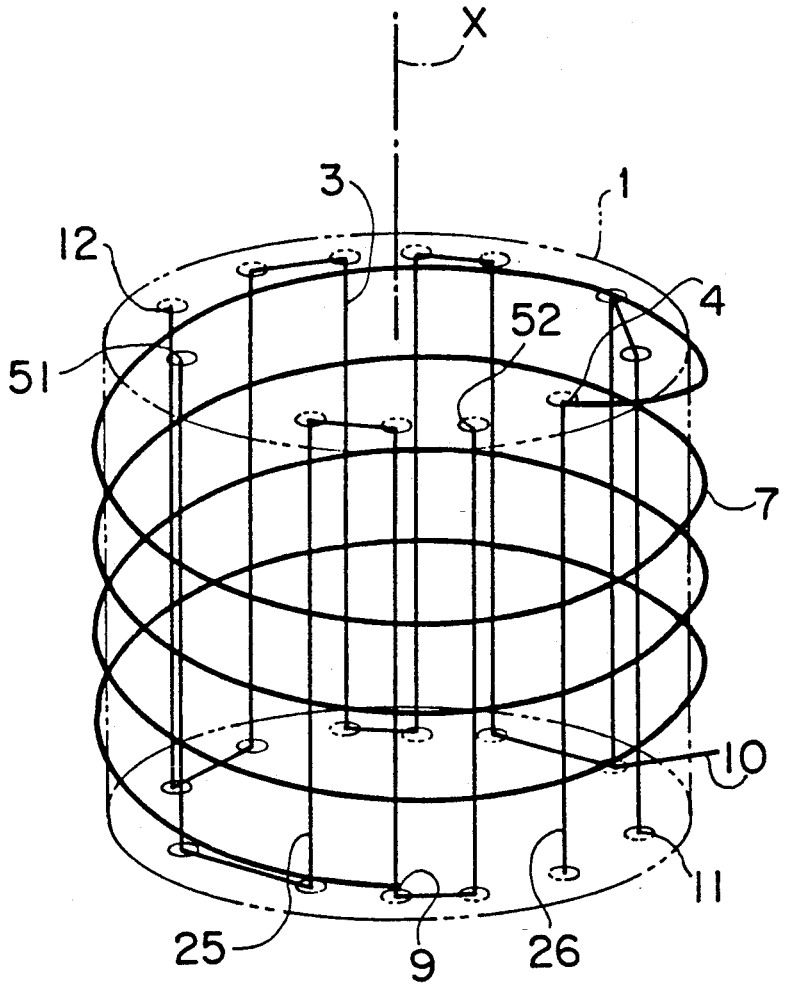
FIG. 11D is a schematic perspective view showing conductors of the FIG. 11A radio apparatus antenna.

FIGS. 11A to 11C are a top view, a side view and a bottom view of an antenna for radio apparatus according to the ninth embodiment of the invention, respectively. FIG. 11D is a perspective view showing first and second conductors 7 and 3 and two fourth conductors 25 and 26. In these figures, components like those of the previously-described third embodiment shown in FIGS. 5A to 5D are designated by identical reference numerals and will not be described herein. The ninth embodiment differs from the third embodiment in that while in the third embodiment the second conductor 3 as a whole takes the meandering form which completely surrounds the center axis X, the second conductor 3 in the ninth embodiment takes as a whole a meandering form which partially surrounds the center axis X, that the ninth embodiment has the two fourth conductors 25 and 26, and that in the ninth embodiment the first conductor 7 is not electrically connected to the second conductor 3 but is electrically connected at a connecting point 4 to the fourth conductor 26. In the ninth embodiment, the fourth conductor 26 is rectilinear. The fourth conductor 25 having one end at a start point 51 extends along guide holes 2 in sequence thereof to take a meandering form and terminates in the other end at an end point 52. Thus, the fourth conductors 25 and 26 are spaced apart from the first conductor 3. The fourth conductor 25 is not electrically connected to any other conductors. Since in the ninth embodiment the first conductor 7 is not electrically connected to the second conductor 3 having a feeding point 10, the first conductor 7 does not act as an open stub on a portion of second conductor 3 lying between start point 11 and feeding point 10. Therefore, in comparison with the second embodiment the order of the previously-described double resonance is decreased to narrow the frequency band which satisfies the matching condition. The ninth embodiment, however, has an unfed section (a set of first and fourth conductors 7 and 26 as well as the fourth conductor 25) and the function of this unfed section can be utilized for fine adjustment of the center frequency of the matching frequency band, thereby facilitating the adjustment of center frequency during fabrication.

A tenth embodiment of the invention will now be described with reference to FIG. 12.

Figure 12:
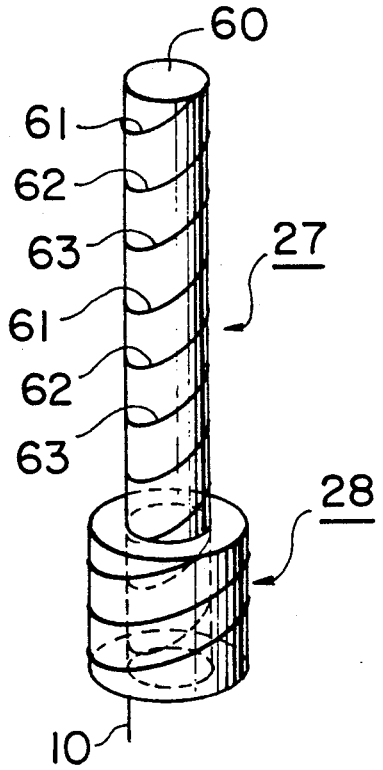
FIG. 12 is a schematic perspective view of an antenna for radio apparatus according to yet still another embodiment of the invention.

FIG. 12 is a schematic perspective view showing an antenna for radio apparatus according to the tenth embodiment of the invention. In FIG. 12, reference numeral 28 designates the radio apparatus antenna of the first embodiment shown in FIGS. 1A to 1D, the radio apparatus antenna of the second embodiment shown in FIGS. 4A to 4C, the radio apparatus antenna of the third embodiment shown in FIGS. 5A to 5D, the radio apparatus antenna of the fifth embodiment shown in FIGS. 7A to 7D, the radio apparatus antenna of the sixth embodiment shown in FIGS. 8A to 8C, the radio apparatus antenna of the seventh embodiment shown in embodiment shown in FIGS. 10A to 10D or the radio apparatus antenna of the ninth embodiment shown in FIGS. 11A to 11D. In FIG. 12, reference numeral 27 designates a helical antenna. The helical antenna 27 includes a columnar dielectric member 60 fitted in the center hole of the dielectric member 1, and conductors 61, 62 and 63 helically wound on the side or circumferential surface of the dielectric member 60 in such a manner that they do not contact with each other. Namely, in the tenth embodiment, the helical antenna 27 has a multi-helical (triple helical in this example) structure. However, the helical antenna may not always be of the multi-helical structure and it may be of a mono-helical structure in which a single conductor is wound helically. The helical antenna 27 has a physical length in the center axis direction which is longer than a physical length in the direction of center axis X of the dielectric member 1. In the tenth embodiment, the helical antenna 27 penetrates through the entire length of the center hole in the dielectric member 1 so as to be held in place and it is coupled with the first and second conductors 7 and 3 under the influence of electromagnetic induction. The helical antenna 27 has no feeding point. Since in the tenth embodiment power supplied from the feeding point 10 is radiated to space from a wider surface are defined by the radio apparatus antenna 28 and helical antenna 27, the direction of power radiation is restricted to improve the directional gain and consequently the gain directive of the whole antenna system can advantageously be improved.

Figure 13:
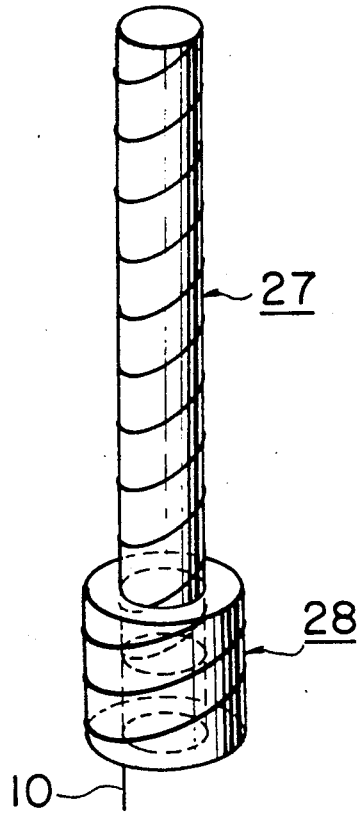
FIG. 13 is a schematic perspective view of an antenna for radio apparatus according to yet still another embodiment of the invention.

Referring now to FIG. 13, an eleventh embodiment of the invention will be described.

FIG. 13 is a schematic perspective view showing an antenna for radio apparatus according to the eleventh embodiment of the invention. In FIG. 13, components like those of the tenth embodiment shown in FIG. 12 are designated by identical reference numerals and their descriptions will be omitted. The eleventh embodiment differs from the tenth embodiment only in that the helical antenna 27 penetrates through a partial length of the center hole in the dielectric member 1 so as to be held in place. The eleventh embodiment can also attain advantages similar to those obtained with the tenth embodiment.

A twelfth embodiment of the invention together with its fabrication method will now be described with reference to FIGS. 14A to 14F. In these figures, components like those of the foregoing individual embodiments are designated by identical reference numerals.

Figure 14A:
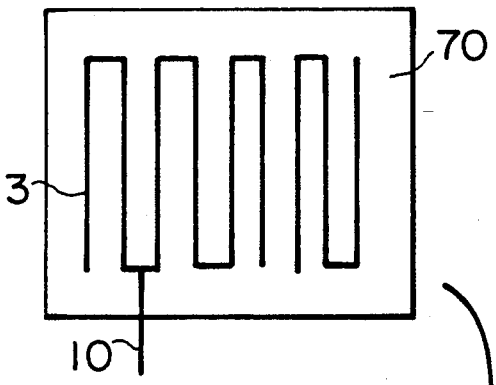
FIGS. 14A to 14F are diagrams showing a fabrication process of an antenna for radio apparatus according to yet still another embodiment of the invention.
Figure 14B:
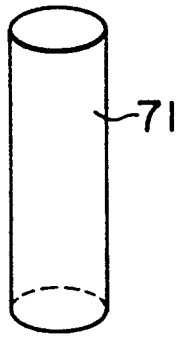
Figure 14C:
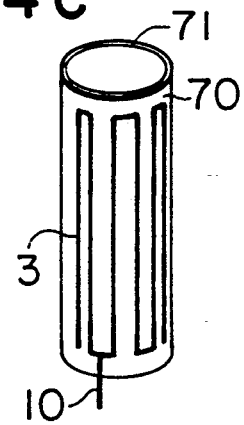
Figure 14D:
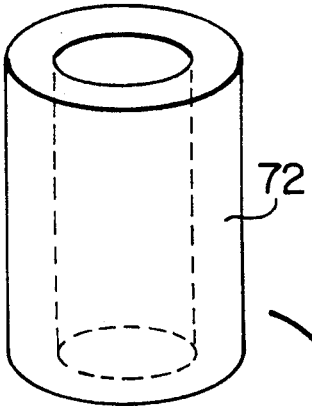
Figure 14E:
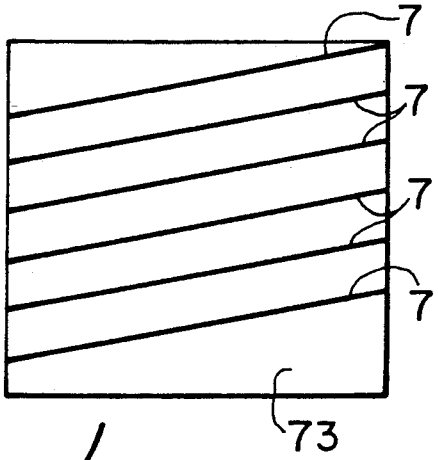
Figure 14F:
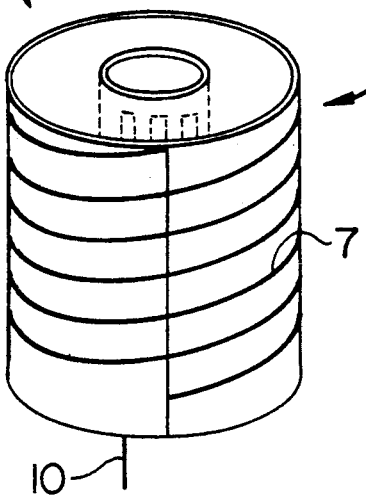

Firstly, a flexible dielectric film 70 as shown in FIG. 14A formed with a printed pattern of a second conductor 3 is prepared. An electrically conductive, thin plate is jointed to the printed pattern to form a feeding point 10. A columnar dielectric member 71 is then prepared. Then, as shown in FIG. 14C, the flexible dielectric film 70 is adhered to the side or circumferential surface of the dielectric member 71. A cylindrical dielectric member 72 as shown in FIG. 14D is prepared. A flexible dielectric film 73 as shown in FIG. 14E formed with a printed pattern of a first conductor 7 is prepared. Subsequently, the dielectric member 71 with the flexible dielectric film 70 is placed in the center hole of the dielectric member 72 and the flexible dielectric film 73 is adhered to the circumferential surface of the dielectric member 72 to complete an antenna for radio apparatus according to the invention as shown in FIG. 14F. Upon adherence of the flexible dielectric film 73, printed patterns of the first conductor 7 are electrically connected to each other in a suitable way. Although not illustrated, a portion of the first conductor 7 is electrically connected to the second conductor 3 in a suitable way. For example, electrically conductive members jointed to the first and second conductors 7 and 3 may be used which bridge upper portions of the first and second conductors 7 and 3 at the top of the FIG. 14F illustration. The radio apparatus antenna of the twelfth embodiment has characteristics similar to those of the third embodiment shown in FIGS. 5A to 5D and obviously, it is easy to fabricate. It will be appreciated that in the twelfth embodiment the flexible dielectric films 70, 73 and the dielectric members 71, 72 form a multi-layer structure which corresponds to the previously-described dielectric member 1.

Individual embodiments of the invention have been described but the present invention is in no way limited to the foregoing embodiments.

For example, in the foregoing embodiments, the second conductor 3 is disposed inside of the first conductor 7 but conversely the second conductor 3 may be disposed outside of the first conductor 7. The dielectric member 1 taking the cylindrical or columnar form in the foregoing embodiments may take other forms such as an elliptically cylindrical form, an elliptically columnar form, a prismatically cylindrical form and a prismatic form. In the foregoing embodiments, the first conductor 7 is laid on the outer circumferential surface of the dielectric member 1 but it may be disposed in the dielectric member 1 or may be laid on the inner circumferential surface of the dielectric member. In the foregoing embodiments, the second conductor 3 is disposed in the dielectric member 1 but it may be laid on the outer or inner circumferential surface of the dielectric member 1. In the foregoing embodiments, the fourth conductor is excluded when the first conductor 7 is electrically connected to the second conductor 3 but even in such a case, the fourth conductor may be included. In the foregoing embodiments, with the third conductor 6 included when the first conductor 7 is electrically connected to the second conductor 3, the third conductor 6 is electrically connected to the second conductor 3 but even in such a case, the third conductor 6 may electrically insulated from any other conductors.

As described above, the present invention can achieve good impedance matching with the exciting source without using any separate matching circuit and therefore can promote miniaturization of the whole antenna system and ensure reduction in cost.

We claim:

1. An antenna for radio apparatus comprising:

a first conductor taking a helical form;

a second conductor which extends to and fro in sequence substantially in a direction of a center axis of the helical form of said first conductor to take, as a whole, a meandering form which is spaced apart from said first conductor and surrounds said center axis; and a dielectric member which lies at least between said first and second conductors, a portion of said first conductor is electrically connected to a portion of said second conductor, said first conductor having at least one open end, said second conductor having at least one open end, and one of a portion of said first conductor and a portion of said second conductor is a feeding point.

2. An antenna for radio apparat according to claim 1 wherein said second conductor is disposed inside of said first conductor.

3. An antenna for radio apparatus according to claim 1 wherein said second conductor is disposed outside of said first conductor.

4. An antenna for radio apparatus according to claim 1 wherein said dielectric member takes a cylindrical form.

5. An antenna for radio apparatus according to claim 4 wherein said first conductor is laid on the outer surface of said dielectric member and said second conductor is disposed in said dielectric member.

6. An antenna for radio apparatus according to claim 4 wherein said first conductor is laid on the outer surface of said dielectric member and said second conductor is laid on the inner surface of said dielectric conductor.

7. An antenna for radio apparatus according to claim 4 wherein said first and second conductors are disposed in said dielectric member.

8. An antenna for radio apparatus according to claim 4 wherein said first conductor is laid on the inner surface of said dielectric member and said second conductor is disposed in said dielectric member.

9. An antenna for radio apparatus according to claim 4 wherein said first conductor is disposed in said dielectric member and said second conductor is laid on the outer surface of said dielectric member.

10. An antenna for radio apparatus according to claim 4 wherein said first conductor is laid on the inner surface of said dielectric member and said second conductor is laid on the outer surface of said dielectric member.

11. An antenna for radio apparatus according to claim 4 wherein said first conductor is disposed in said dielectric member and said second conductor is laid on the inner surface of said dielectric member.

12. An antenna for radio apparatus according to claim 4 further comprising a helical antenna, said helical antenna having a physical length in the center axis direction which is longer than a physical length in the center axis direction of said dielectric member, said helical antenna penetrating at least a part of the center hole of said dielectric member so as to be held in place and being coupled with said first and second conductors under the influence of electromagnetic induction.

13. An antenna for radio apparatus according to claim 12 wherein said helical antenna has a multi-helical structure.

14. An antenna for radio apparatus according to claim 1 wherein said dielectric member takes a columnar form.

15. An antenna for radio apparatus according to claim 14 wherein said first conductor is laid on the outer surface of said dielectric member and said second conductor is disposed in said dielectric member.

16. An antenna for radio apparatus according to claim 14 wherein said first and second conductors are disposed in said dielectric member.

17. An antenna for radio apparatus according to claim 14 wherein said first conductor is disposed in said dielectric member and said second conductor is laid on the outer surface of said dielectric member.

18. An antenna for radio apparatus according to claim 1 wherein said second conductor as a whole surrounds said center axis completely.

19. An antenna for radio apparatus according to claim 1 wherein said second conductor as a whole surround said center axis partially.

20. An antenna for radio apparatus according to claim 1 wherein a part of sequential portions of said second conductor extending to and fro in the center axis direction is disposed in an inner one of imaginary double cylindrical surfaces assumed to surround said center axis, and the remaining part of sequential portions of said second conductor extending to and fro in the center axis direction is disposed in an outer one of said imaginary double cylindrical surfaces

21. An antenna for radio apparatus according to claim 1 further comprising at least one third conductor taking a helical form which is substantially centered on the center axis of the helical form of said first conductor.

22. An antenna for radio apparatus according to claim 21 wherein said at least one third conductor and said first conductor form a multi-helical structure in which they do not contact with each other.

23. An antenna for radio apparatus according to claim 21 further comprising at least one fourth conductor spaced apart from said first conductor.

24. An antenna for radio apparatus according to claim 23 wherein a portion of said at least one fourth conductor is electrically connected to a portion of said second conductor.

25. An antenna for radio antenna according to claim 23 wherein a portion of said at least one fourth conductor is electrically connected to a portion of said first conductor.

26. An antenna for radio apparatus according to claim 23 wherein said at least one fourth conductor is insulated from all of the other conductors.

27. An antenna for radio apparatus according to claim 21 wherein a portion of said at least one third conductor is electrically connected to a portion of said second conductor.

28. An antenna for radio apparatus antenna according to claim 19 wherein a portion of said at least one third conductor is electrically connected to a portion of said first conductor.

29. An antenna for radio apparatus according to claim 21 wherein said at least one third conductor is insulated from all of the other conductors.

30. An antenna for radio apparatus according to claim 1 wherein the portion of said second conductor acts as the feeding point, said antenna further comprises at least one third conductor taking a helical form substantially centered on the center axis of the helical form of said first conductor, and a portion of the third conductor is connected to a portion of said second conductor which are on the same side, with respect to said feeding point, as a position of said second conductor to which a portion of said first conductor is electrically connected.

31. An antenna for radio apparatus according to claim 1 wherein the portion of said second conductor acts as the feeding point, a portion of said first conductor electrically connected to a portion of said second conductor is one end of said first conductor, said second conductor rounds, in a direction about said center axis, from a position of said feeding point toward a position of said second conductor to which said one end of said first conductor is electrically connected, and said first conductor rounds, in the same direction as said direction about said center axis, from said one end of said first conductor toward the other end thereof.

32. An antenna for radio apparatus according to claim 1, wherein said dielectric member takes an elliptically cylindrical form.

33. An antenna for radio apparatus according to claim 1, wherein said dielectric member takes a prismatically cylindrical form.

34. An antenna for radio apparatus according to claim 1, wherein said dielectric member takes an elliptically columnar form.

35. An antenna for radio apparatus according to claim 1, wherein said dielectric member takes a prismatically columnar form.

36. An antenna for radio apparatus according to claim 1, wherein an impedance of the antenna is matched with a feeding impedance by selecting a position of the feeding point on the second conductor, a length of the first conductor, and a position of the portion of the second conductor which is electrically connected to the first conductor.

37. An antenna for radio apparatus comprising:

a first conductor taking a helical form;

a second conductor which extends to and fro in sequence substantially in a direction of a center axis of the helical form of said first conductor to take, as a whole, a meandering form which is spaced apart from said first conductor and surrounds said center axis, said second conductor is insulated from said first conductor;

a dielectric member which lies at least between said first and second conductors; and at least one third conductor spaced apart from said first conductor, a portion of said second conductor is a feeding point and a portion of said first conductor is electrically connected to a portion of said at least third conductor.

38. An antenna for radio apparatus according to claim 37, wherein an impedance of the antenna is matched with a feeding impedance by selecting a position of the feeding point on the second conductor, a length of the first conductor, and a length of the third conductor.

* * * * *